US007798291B2

(12) United States Patent
Felder

(10) Patent No.: US 7,798,291 B2
(45) Date of Patent: Sep. 21, 2010

(54) EMERGENCY DEVICE FOR INSTALLING IN AN ELEVATOR CAR OF AN ELEVATOR INSTALLATION

(75) Inventor: Hugo Felder, Buchrain (CH)

(73) Assignee: Inventio AG, Hergiswil NW (CH)

( * ) Notice: Subject to any disclaimer, the term of this patent is extended or adjusted under 35 U.S.C. 154(b) by 88 days.

(21) Appl. No.: 12/045,114

(22) Filed: Mar. 10, 2008

(65) Prior Publication Data

US 2008/0217114 A1 Sep. 11, 2008

(30) Foreign Application Priority Data

Mar. 9, 2007 (EP) ..... 07103879

(51) Int. Cl.
*B66B 5/00* (2006.01)

(52) U.S. Cl. ..... 187/414; 187/395

(58) Field of Classification Search ..... 187/395, 187/414

See application file for complete search history.

(56) References Cited

U.S. PATENT DOCUMENTS 4,685,539 A 8/1987 Tsuji et al.
5,691,711 A * 11/1997 Jorgensen ..... 340/5.67
5,999,095 A * 12/1999 Earl et al. ..... 340/542
6,000,609 A * 12/1999 Gokcebay et al. ..... 235/382
6,318,137 B1 * 11/2001 Chaum ..... 70/278.3
7,012,503 B2 * 3/2006 Nielsen ..... 340/5.6
2002/0189307 A1 * 12/2002 Gokcebay et al. ..... 70/278.3
2003/0205070 A1 * 11/2003 Chaum ..... 70/278.3
2004/0245052 A1 12/2004 Felder

FOREIGN PATENT DOCUMENTS

EP 0 190 406 B1 8/1986
JP 3-293279 * 12/1991
JP 2000-153968 * 6/2000
WO WO 2005/095249 A1 10/2005

* cited by examiner

*Primary Examiner*—Thomas J. Brahan
(74) *Attorney, Agent, or Firm*—Fraser Clemens Martin & Miller LLC; William J. Clemens

(57) ABSTRACT

An emergency device for installing in an elevator car of an elevator installation, with an emergency control region, which is to be opened from the interior of the elevator car by an emergency key, wherein a key switch is arranged in the emergency control region so as to transfer the elevator installation to an emergency operation by the same emergency key. Mounted in the elevator car is a key mechanism which has a mechanical profile insert with a key slot and is designed so that through insertion of the emergency key into the key slot and turning the emergency control region is mechanically unlocked. The key switch includes an electromechanical key insert with a key slot and is so designed that through insertion of the emergency key into the key slot and turning the elevator installation can be switched over to the emergency operation.

8 Claims, 3 Drawing Sheets

EMERGENCY DEVICE FOR INSTALLING IN AN ELEVATOR CAR OF AN ELEVATOR INSTALLATION

FIELD OF THE INVENTION

The present invention relates to an emergency device, preferably a fire brigade emergency device, for installing in an elevator car of an elevator installation.

BACKGROUND OF THE INVENTION

In some countries, for example in the USA, there are regulations which establish that an elevator car has to be operable in the case of emergency (for example when it burns) by the fire department. In the USA, for example, this fire department function (fire fighter function) has to be arranged as a control group in the upper region of the general control panel in the interior of the elevator car. The control group has to lie behind a closable cover. Moreover, it is prescribed that this cover has to be opened by a special key which is, typically, in the hands of the fire department. After the cover has been opened by the fire department with the special key, the fire department has to be in a position to switch over, by the same key, the elevator control to a special mode (emergency mode). This takes place through actuation of a key switch by means of the special key.

It is a disadvantage of the previous installations of that kind that through the use of two identical key switches (the first for opening the cover and the second for actuating the control group) this emergency device is relatively expensive. In addition, if the emergency device is to be modified, for example because keys have been lost, both key switches have to be exchanged for two identical new ones.

SUMMARY OF THE INVENTION

An object of the present invention is therefore to provide an emergency device which is more favorable in manufacture, but nevertheless offers the same security as previous emergency devices. Moreover, the emergency device shall fulfill the corresponding local rules and regulations.

According to the present invention an emergency device is proposed which is suitable for installing in an elevator car of an elevator installation. The emergency device comprises a so-termed emergency control region which is to be opened from the interior of the elevator car by an emergency key, wherein a key switch is arranged in the emergency control region in order to be able to transfer, by the emergency key, the elevator installation to emergency operation. Mounted in the elevator car is a key mechanism which has a mechanical profile insert with key slot and which is designed so that, through insertion of the emergency key into the key slot and turning, the emergency control region is mechanically unlocked and freed. The key switch of the emergency device thereagainst comprises an electromechanical key insert with key slot and is designed so that through insertion of the emergency key into the key slot and turning the elevator installation can be switched over to the emergency operation.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The scope of the present patent application, as already indicated, concerns emergency devices such as used in elevator installations. A system or unit is termed emergency device which makes it possible for a specific or authorized group of persons, for example employees of the fire department, police or the like, to transfer the elevator installation to an emergency mode. For this purpose use is made of a key which is here termed emergency key.

Figure 1:
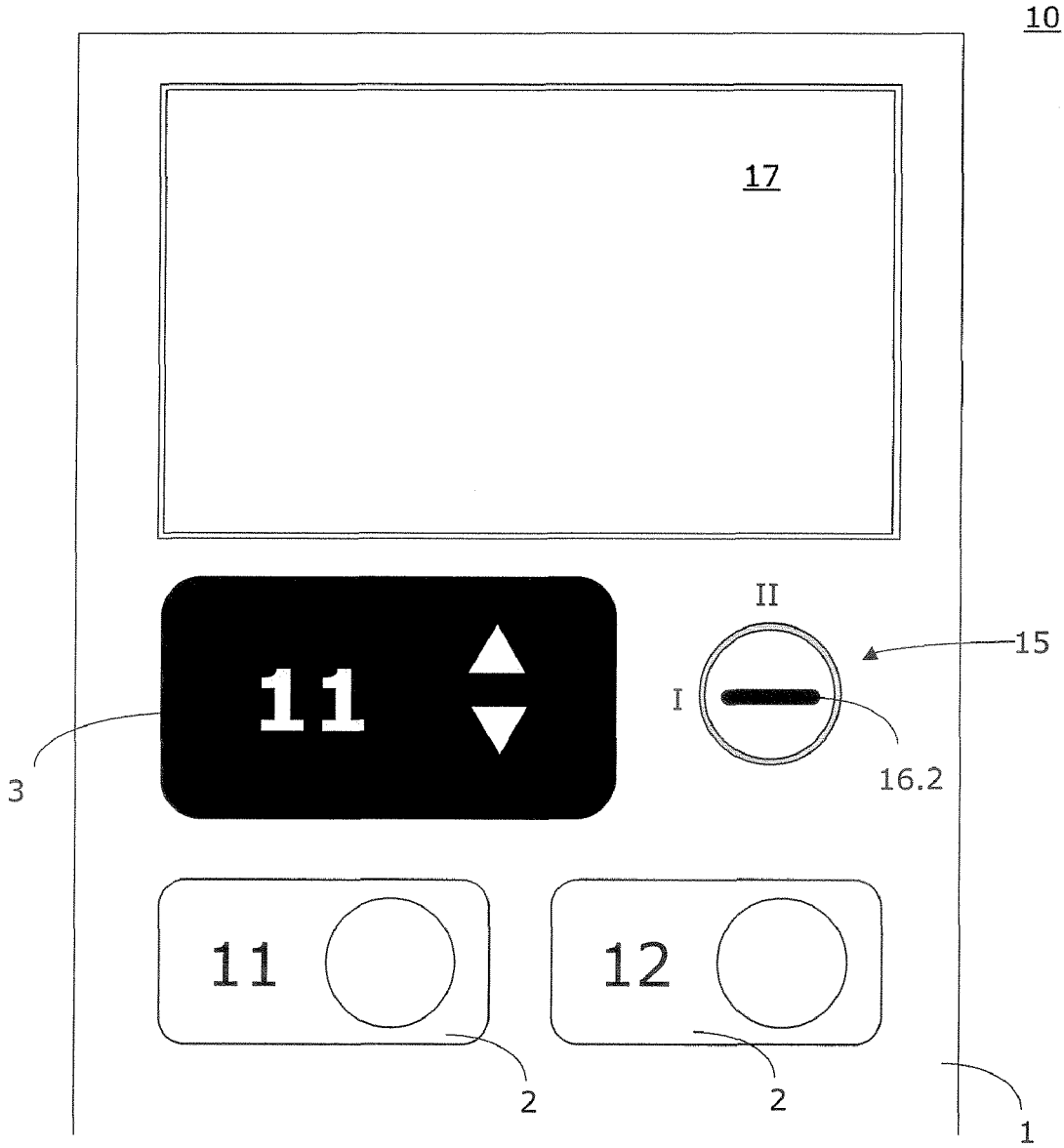
FIG. 1 shows a part of a control panel with an emergency device according to the present invention, in a simplified schematic illustration, wherein the emergency device is closed.
Figure 1:
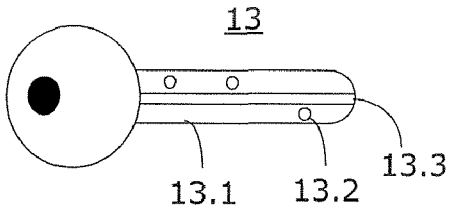

Such an emergency key 13 is shown in FIG. 1 in a simplified illustration. According to the present invention the emergency key 13 is so designed that it mechanically co-operates with counter-elements of a key cylinder as soon as the web 13.1 of the emergency key 13 is inserted into the key cylinder. Only if the correct emergency key 13 is inserted can it then be turned in a next step. In order to prevent manipulation of the key cylinder by simple tools, mechanical features, for example small depressions 13.2 and/or grooves 13.3, are provided at the key web 13.1. The key web 13.1 can, however, also have, as is commonplace, one or two comb-like edges.

Figure 2:
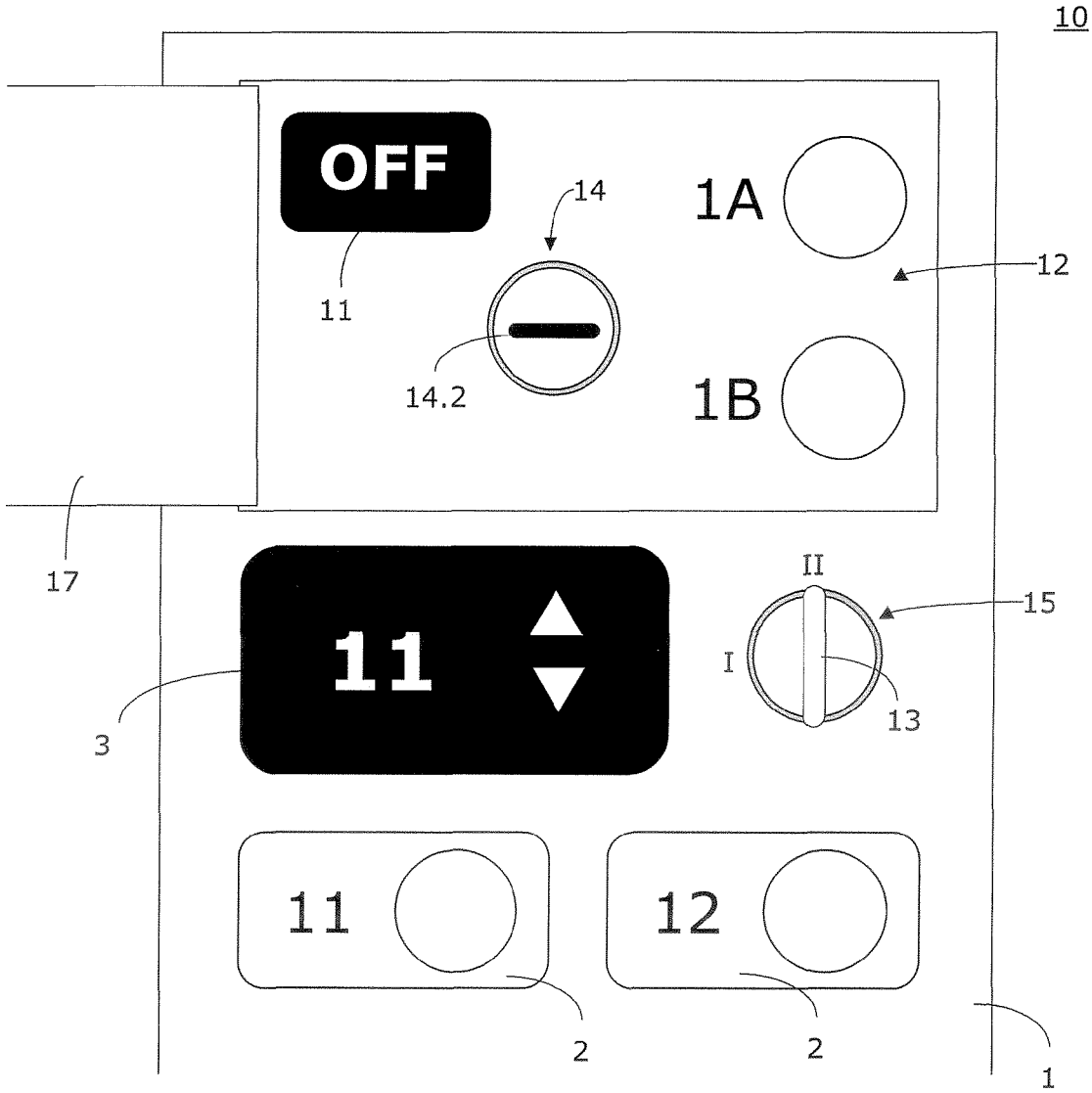
FIG. 2 shows a part of the control panel of FIG. 1 with the emergency device according to the present invention, in a simplified schematic illustration, wherein the emergency device is opened.

Details of the invention are described on the basis of an example of embodiment which is shown in FIGS. 1 and 2.

An emergency device 10 according to the present invention as part of a control panel 1 is shown in FIG. 1. The emergency device 10 is usually seated in the upper region of the control panel 1. The control panel 1 can have a row of control elements 2 and be equipped with a display 3.

The emergency device 10 can, however, also be arranged at another location in an elevator car.

According to the present invention a key mechanism 15 is mounted in the elevator car and has a mechanical profile insert 16.1 (see FIG. 3) with a key slot 16.2. The key mechanism 15 is designed so that, through insertion of the emergency key 13 into the key slot 16.2 and by turning, the emergency control region 12 (see FIG. 2) is mechanically unlocked and freed. In FIG. 1 the emergency control region 12 is closed by a cover 17 and protected against unauthorized access.

The key mechanism 15 is a pure mechanically operating lock mechanism, wherein the key mechanism 15 comprises a mechanical profile insert 16.1 which is quasi designed as a counter-element or matrix with respect to the emergency key 13. Through a special design of the mechanical profile insert 16.1 it can be ensured that only "authorized" emergency keys 13 enable opening of the emergency control region 12.

In FIG. 2 there is shown a situation where the emergency key 13 was inserted into the key mechanism 15 and turned from a first setting (denoted by I) to a second setting (denoted by II). Through this turning of the emergency key 13 the key mechanism 15 opens the cover of the emergency control region 12. The cover 17 shown in FIG. 2 is a form of door which abuts on the left and pivots away to the left, as indicated in FIG. 2. However, instead of a door there can also be provided, as the cover 17, a flap, plate, form of roller blind or a slide, which can be pivoted away or pushed way in a desired direction.

After the cover 17 has been opened by the emergency key 13 the key 13 can be withdrawn from the key slot 16.2 and inserted into the key switch 14. This key switch 14 now differs from the key mechanism 15 in that it is here a conventional key switch which converts a mechanical rotational movement, which is produced by turning the emergency key 13, into an electrical switching or scanning process. In addition, the key switch 14 has a key cylinder (analogous to the profile insert 16.1) which ensures that only "authorized" emergency keys 13 enable switching over of the elevator installation.

As indicated in FIG. 2, special control elements, for example switches or pushbuttons 1A and 1B, as well as displays, for example display 11, are provided in the emergency control region 12. The display 11 can be so designed, for example, that it indicates the state of the emergency device 10. In FIG. 2 the emergency device 10 is shown in a switched-off state (OFF).

Figure 3:
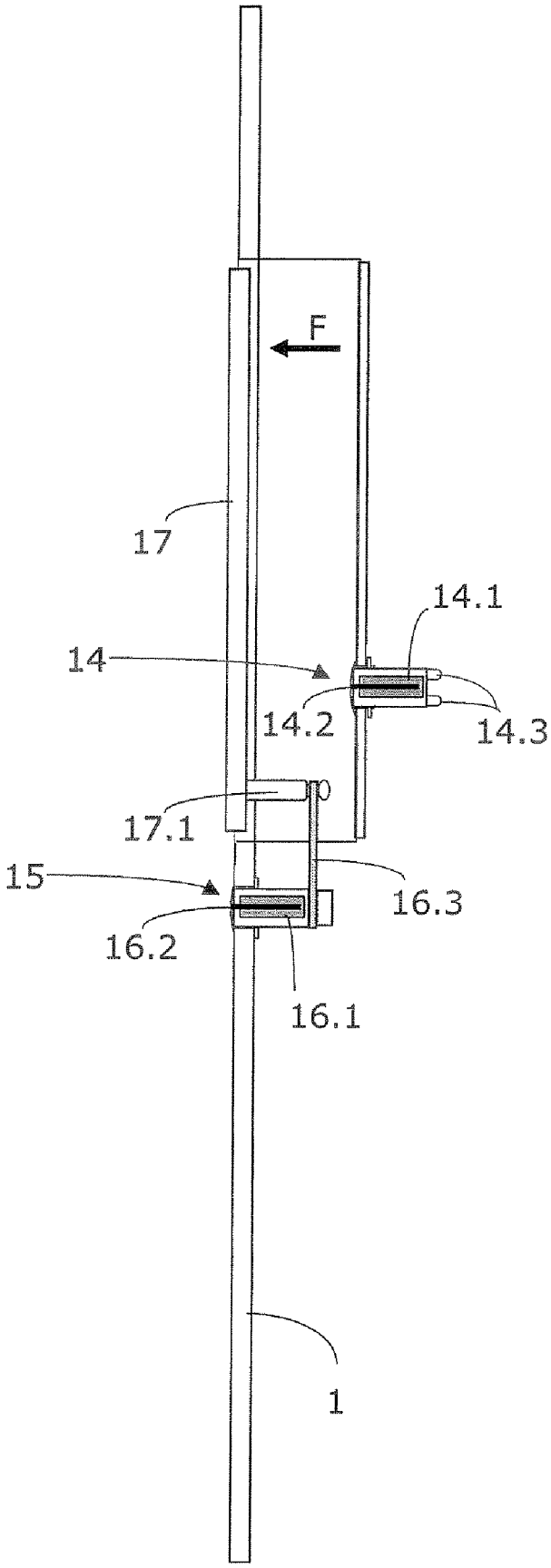
FIG. 3 is a side elevation view of a part of a control panel with the emergency device according to the present invention, in a simplified schematic illustration, wherein the emergency device is closed.

In a currently preferred form of embodiment of the present invention the mechanical profile insert 16.1 of the key mechanism 15 comprises a counter-element or a matrix, which substantially represents a negative form of a region of the key web 13.1 of the emergency key 13 (FIG. 3). It can thereby be ensured that the emergency key 13 after plugging into the key slot 16.2 of the key mechanism 15 can be rotated only if it is an emergency key 13 which mechanically fits ("authorized" emergency key 13). The mechanical profile insert 16.1 can, depending on the form of embodiment of the emergency key 13, also have small spring elements which detent in the depressions 13.2 and/or grooves 13.3 of the key web 13.1.

The emergency device 10 is preferably designed so that the emergency control region 12 is protected by the cover 17 against unauthorized access. This cover 17 can be mechanically unlocked and opened only by turning the emergency key 13 in the key slot 16.2 of the key mechanism 15.

Preferably, through turning the emergency key 13 in the key slot 16.2 of the key mechanism 15 a spring mechanism is triggered which mechanically opens the cover 17 so as to automatically free the emergency control region 12.

For this purpose, as shown in FIG. 3 on the basis of an example of embodiment, the key mechanism 15 can be disposed in mechanical co-operation with a lever element or a latch 16.3 with a spigot 17.1 of the emergency device 10. If now the emergency key 13 is inserted into the key slot 16.2 and turned, the lever element or the latch 16.3 rotates and frees the spigot 17.1. In addition, the lever element or the latch 16.3 can be constructed as a spring element which has to be pressed away rearwardly by the key in order to free rotation of the key. The cover 17 now automatically springs open if a corresponding spring element (not shown) exerts a force F on the cover 17. After use of the emergency device 10 the cover 17 can be pressed closed against the spring force F of the spring element. Through rotation of the emergency key 13 in the key slot 16.2 into the setting "I" the spigot 17.1 is then locked again by the lever element or the latch 16.3. The spring element is part of the mentioned spring element.

It is additionally indicated in FIG. 3 that the key switch 14 is an electromechanical element. Two electrical contacts 14.3 are indicated on the rear side of this switch 14. However, more than two contacts 14.3 can also be provided. It can also be seen in FIG. 3 that the key mechanism 15 is so constructed that it has a mechanical profile insert 16.1 with a key slot 16.2. The key switch 14 also has a similar profile insert 14.1, wherein this is of somewhat different design due to the fact that it operates electromechanically.

A form of embodiment in which the mechanical profile insert 16.1 is designed as a metal or plastics material element is particularly preferred. Preferably the insert 16.1 can be installed in problem-free manner in the key mechanism 15 and is economic to produce. Particularly preferred are metal or plastics material elements which were processed by means of laser in order to serve as profile insert 16.1 for an emergency key 13.

It is an advantage of the device 10 according to the invention that the key mechanism 15 is adaptable to the respective "authorized" emergency key 13 by exchange of the profile insert 16.1 in problem-free manner, quickly and economically.

A form of embodiment of the invention has proved particularly satisfactory in which the key mechanism 15 has substantially the same installation volume as the key switch 14. Moreover, the key mechanism 15 should, considered from the interior of the elevator car, not differ from the key switch 14. In other words, both switches 14 and 15, whether they are now internally constructed to be purely mechanical or electromechanical, should not visually differ externally in the installed state.

The present invention is particularly suitable for realizing a fire department unit (fire fighting unit) for elevator installations.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An emergency device for installing in an elevator car of an elevator installation, with an emergency control region which is to be opened from the interior of the elevator car by an emergency key, wherein a key switch is arranged in the emergency control region in order to transfer, by the emergency key, the elevator installation to an emergency operation, comprising:

a key mechanism mounted in the elevator car which has a mechanical profile insert with a key slot and which, through insertion of the emergency key into the key slot and turning, the emergency control region is mechanically unlocked, wherein said mechanical profile insert includes a single counter-element which substantially resents a complementary form of a region of the emergency key; and a key switch having an electromechanical key insert with a key slot which, through insertion of the emergency key into the key switch key slot and turning, the elevator installation can be switched over to the emergency operation.

2. The emergency device according to claim 1 wherein the emergency key after insertion into said key slot of said key mechanism can be turned only if it is an emergency key which mechanically fits.

3. The emergency device according to claim 1 wherein the emergency control region is protected by a cover against unauthorized access, and said cover is mechanically unlocked by turning of the emergency key in said key slot of said key mechanism.

4. The emergency device according to claim 3 wherein through turning of the emergency key in said key slot of said key mechanism a spring mechanism can be released which mechanically opens the cover so as to automatically free the emergency control region.

5. The emergency device according to claim 1 wherein said profile insert is formed of at least one of a metal and a plastics material.

6. The emergency device according to claim 1 wherein said key mechanism is adaptable to the respective emergency key by exchange of said profile insert.

7. The emergency device according to claim 1 wherein said key mechanism has substantially the same installation mass as the key switch and said key mechanism when viewed from the interior of the elevator car is not distinguishable from said key switch.

8. The emergency device according to claim 1 wherein the emergency key includes a key web and has at least one of a depression and a groove provided on a face of the key web, the mechanical profile insert accepting only the key web of the emergency key.

* * * * *